US006505763B2

(12) United States Patent
Rota

(10) Patent No.: US 6,505,763 B2
(45) Date of Patent: Jan. 14, 2003

(54) CIRCUMFERENTIALLY CONTINUOUS ARRANGEMENT WHICH IS TO BE WORN PREFERABLY ON THE WRIST AND HAS A HINGED CLOSURE

(75) Inventor: Flavio Rota, Biel (CH)

(73) Assignee: Meliga Habillement Horloger SA, Beil/Bienne (CH)

( * ) Notice: Subject to any disclaimer, the term of this patent is extended or adjusted under 35 U.S.C. 154(b) by 0 days.

(21) Appl. No.: 09/776,703

(22) Filed: Feb. 6, 2001

(65) Prior Publication Data

US 2002/0017539 A1 Feb. 14, 2002

(30) Foreign Application Priority Data

Aug. 2, 2000 (EP) ..... 00810699

(51) Int. Cl.[7] ..... A44C 5/00

(52) U.S. Cl. ..... 224/174; 224/176; 224/179; 24/265 WS; 63/9

(58) Field of Search ..... 224/164, 174, 224/176, 179; 24/265 WS, 71 J, 71 T; 63/3.2, 7, 9

(56) References Cited

U.S. PATENT DOCUMENTS

| | | | | | |
|---|---|---|---|---|---|
| 1,165,872 | A | * | 12/1915 | Hadley | 24/71 J |
| 1,673,117 | A | * | 6/1928 | Kestenman | 224/176 |
| 1,700,992 | A | * | 2/1929 | Augenstein | 24/265 B |
| 1,701,020 | A | * | 2/1929 | Speidel et al. | 24/71 J |
| 1,740,432 | A | * | 12/1929 | Speidel et al. | 224/176 |
| 1,741,421 | A | * | 12/1929 | Kraemer | 24/71 J |
| 1,778,044 | A | * | 10/1930 | Speidel et al. | 224/176 |
| 1,827,364 | A | * | 10/1931 | Johnson et al. | 24/71 J |
| 1,910,739 | A | * | 5/1933 | Baker | 24/327 |
| 2,004,206 | A | * | 6/1935 | Kestenman | 24/71 J |
| 2,169,738 | A | * | 8/1939 | Moody | 368/281 |
| 3,550,216 | A | * | 12/1970 | Gandelman | 24/265 WS |
| 4,748,604 | A | | 5/1988 | Lambert | |
| 6,308,382 | B1 | * | 10/2001 | Takahashi et al. | 24/265 WS |

FOREIGN PATENT DOCUMENTS

| | | | | |
|---|---|---|---|---|
| CH | A3662031 | | 9/1987 | |
| DE | 621286 | | 11/1935 | |
| EP | 0208168 | | 1/1987 | |
| FR | 387727 | | 7/1908 | |
| GB | 202545 | * | 8/1923 | 224/179 |
| GB | 405452 | | 2/1934 | |

* cited by examiner

*Primary Examiner*—Stephen K. Cronin
(74) *Attorney, Agent, or Firm*—Birch, Stewart, Kolasch & Birch, LLP

(57) ABSTRACT

A circumferentially continuous arrangement which is to be worn preferably on the wrist has a strap and a hinged closure which serves for changing the circumferential extent of the arrangement. The hinged closure has a central closure part and at least one toggle lever which is connected to the closure part in one end region and has a strap end fastened at its other end region. The collapsible toggle lever, which is connected in each case to the strap end and is circumferentially offset with respect to the central closure part, and the central closure part are designed and connected to one another such that, for the direct transition from the closed state of the hinged closure to the open state, the central closure part has to be moved outward.

18 Claims, 4 Drawing Sheets

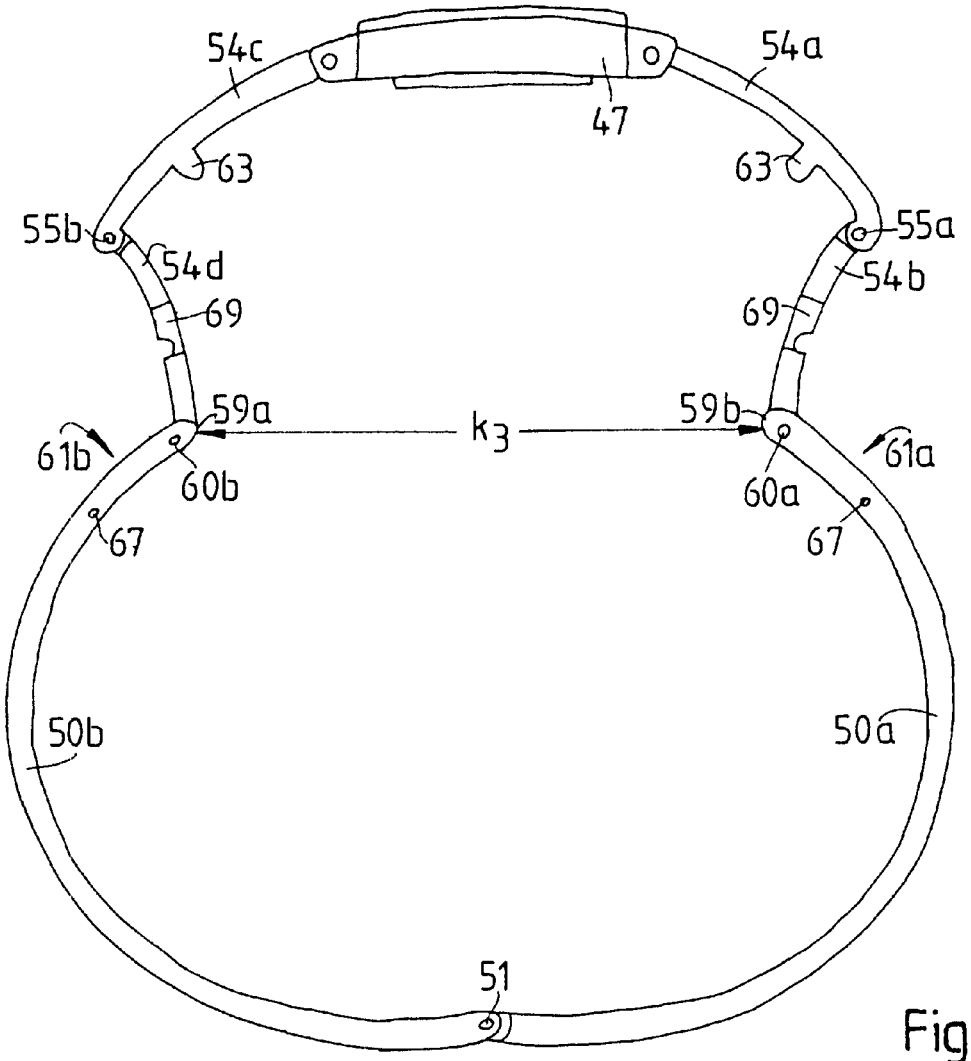
Fig. 9
Fig. 7
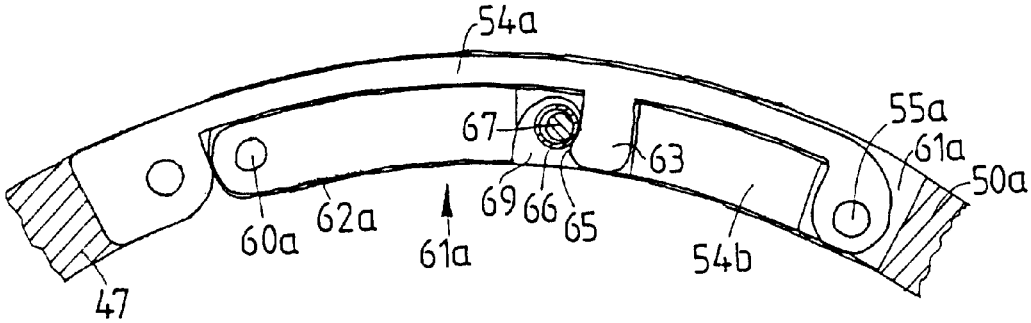

CIRCUMFERENTIALLY CONTINUOUS ARRANGEMENT WHICH IS TO BE WORN PREFERABLY ON THE WRIST AND HAS A HINGED CLOSURE

TECHNICAL FIELD

The invention relates to an arrangement which is to be worn preferably on the wrist.

PRIOR ART

An eye-catching object is understood as being a jewelry element (precious-stone arrangements, crowns, etc.), a watchcase, a display element (mini calculator, mini pager, etc.), etc.

Hinged closures are used, in particular, for watch-straps (although this is not necessarily the case). They are also referred to as folding closures. The hinged closure with the strap ends fastened on it forms a continuous, so-called strap. When the hinged closure is opened, only the circumference of the strap is increased such that the hand can be slipped in and out. The strap is not separated in any way.

A strap is understood as being all types of means which can enclose the forearm in the vicinity of the wrist and at the ends of which a hinged closure may be provided. In the broader sense, a strap is also understood as being a means which can be placed around the foot in the region of the ankle. In the broadest sense, a necklace and a belt also fall into this category.

An arrangement with a Z-closure on a watch-strap is known from U.S. Pat. No. 4,748,604. The known closure had a watchcase as an eye-catching object. The watchcase was designed in two parts with a top part bearing a watch movement and with a watch base. The top part and the watch base were connected in an articulated manner to a link. The watch base was designed such that the top part and link could be positioned in it. One strap end was articulated on the top part and the other strap end was articulated on the bottom part. For opening purposes, it was necessary to use one's fingernail to raise one side of the watchcase from the watch base as "Z-base".

British Patent Application GB-A 405 452 describes a circumferentially closed arrangement with a hinged closure. The hinged closure had a central closure part with toggle levers arranged symmetrically on both sides with respect to the closure part. The central closure part had a timepiece as an eye-catching object. Each toggle lever had two leg parts connected to a pivot articulation, in which case that end of a first leg part directed away from the pivot articulation was connected pivotably to the watchcase and that end of the second leg part directed away from the pivot articulation was connected pivotably to the strap end. In the closed state of the arrangement, the leg parts were in the collapsed state, in which case the first leg part came to rest on the inner side, and the second leg part came to rest on the outer side, of the arrangement. In order to open the arrangement or the hinged closure, the fingernail was used to grip beneath the pivot articulation, connecting the two leg parts and located adjacent to the central closure part, and to draw it outward, as a result of which the hinged closure swung open and thus increased the circumference of the arrangement. It was then possible for the arrangement to be slipped off the wrist.

An arrangement with a hinged closure in which a watchcase was arranged is likewise known from Swiss Patent CH-A 662 031. In each case two fork-shaped pivot levers which are connected to one another by an articulation at the fork-tine ends gripped around the watchcase to the left and right. The watchcase was thus the central part ("common supporting plate") of the hinged closure. The two articulations at the fork-tine ends were located beside the other, on the outside of the watchcase, in the closed state. In order to open the hinged closure (increase the circumference of the arrangement) it was necessary to use one's fingernail to grip beneath at least one of the articulations and draw the same outward.

German Patent DE-C 621 286 has disclosed an arrangement which was not of the generic type and had a closure and a link strap. An eye-catching object was not present. In addition, the closure mainly had a central closure part, at the ends of which in each case a single leg was arranged by way of a first pivot articulation. At the leg end not connected to the central closure part, the link strap was then fastened by a second pivot articulation. The central closure part is arranged such that it remains directed towards-the inner side of the arrangement, that is to say the wrist, in each case. In the closed state of the arrangement, the second pivot articulations were located on the central closure part. In order to open the arrangement, it was necessary to use one's fingernail to grip beneath at least one of the second pivot articulations and draw the same upward. An arrangement analogous to this is described in EP-A 0 208 168.

OBJECT OF THE INVENTION

The object of the invention is to provide a circumferentially continuous arrangement which is to be worn preferably on the wrist and has a strap and a hinged closure which serves for changing the circumference, said arrangement, firstly, remaining reliably in a shortened-circumference state by means of a collapsed hinged closure, secondly, being easily opened, in particular in a "fingernail-friendly" manner, to increase the circumference, and thirdly, having an aesthetically pleasing appearance in particular, in the closed state.

ACHIEVING THE OBJECT

The object is achieved in that the collapsible toggle lever, which is connected to the strap end and is offset circumferentially with respect to the central closure part, and the central closure part are designed and connected to one another such that, for the direct transition from the closed state of the hinged closure to the open state, the central closure part has to be moved, or moves, outward. This means, that for opening purposes, the central closure part has to be drawn outward, i.e. upward in the case of an arrangement which has to be worn on the wrist, or it moves a predetermined radical distance in the outward direction; it springs open such that it can be gripped to good effect. The hinged closure may be constructed asymmetrically with one toggle lever or asymmetrically or symmetrically with two toggle levers.

In contrast to the closures described in U.S. Pat. No. 4,748,604, GB-A 405 452, CH-A 662 031, DE-C 621 286 and EP-A 0 208 168, no more "fingernail-breaking actions" are necessary, according to the invention, in order to open the closure. The central closure part is now simply drawn upward or radially outward; in one variant, it even springs open by a lateral pressure being applied to the bracelet-design strap. The central closure part can be gripped laterally by the thumb and a further finger in order to be opened and then to be opened further.

In a preferred variant, in addition, the strap of the arrangement comprises at least two non-deformable bracelet parts which are adapted to the wrist contour, are designed preferably symmetrically to one another and are connected pivotably to one another by a bracelet pivot articulation. Each toggle lever, the central closure part and the two bracelet parts are then designed such that the bracelet end edges are only spaced apart from one another by a minimal spacing when the central closure part is raised up outward by a gripping distance. By lateral pressing on the broad sides (outer sides) of the bracelet parts, in a radially inward direction following the collapsed toggle levers, opening of the arrangement is then satisfactory possible by virtue of the central closure part springing up from the closed state and being gripped in order to be opened further.

Each toggle lever is constructed from two leg parts which are each connected to one another by a pivot articulation. The toggle lever may then be connected fixedly or also pivotably to the central closure part by way of one leg part. If it is connected fixedly to the closure part, this results in the straightforward, fingernail-friendly closing and opening operation described hereinbelow. This is because it is no longer the case, as with the prior art, that it is necessary to use one's fingernails to grip beneath the pivot articulation, which connects the pivot parts, and to draw the same upward.

The arrangement according to the invention can be designed together with the above mentioned hinged closure in such an aesthetically pleasing manner, that even on its own it acts as a piece of jewellery wearable on the wrist. If, in addition, the central part of the hinged closure is provided with an eye-catching object, this gives an expediently designed and attractive piece of jewelry, especially if the strap or bracelet parts are also artistically fashioned.

In contrast to that in U.S. Pat. No. 4,748,604, the eye-catching object arranged on the hinged closure in one variant is not in two parts. In the variant of the invention, the eye-catching object is a single-piece part of a symmetrically constructed hinged closure. This avoids the injury-causing corners and edges of the base part from U.S. Pat. No. 4,748,604. In a preferred embodiment, it is also possible for the solution according to the invention to achieve an aesthetically pleasing appearance of a closed bracelet. The strap will preferably be designed as a watch-strap. However, variants in which use is made of eye-catching objects other than the watchcase, as has been indicated above, are also possible.

To emphasize an aesthetically pleasing shaping, it is possible, in particular, for the two toggle levers of the hinged closure to be positioned in a flash manner in cutouts in the end regions of the strap. For this purpose, the sum of the thicknesses of the two leg parts of each toggle lever, apart from a tolerance, is equal to the thickness of the strap end region. In this case, in each case one leg part is of concave design and the other is of convex design with a curvature of the respective strap end region in order that, in the closed state of the arrangement, the collapsed toggle levers are positioned in a surface-flash manner in the respective cutout.

In addition, the two toggle levers and the associated cutout will preferably be designed such that the toggle levers are located with latching action in the cutouts and can be swung out or open for opening purposes only by a slight force being applied. In addition, the toggle lever and cutout will be designed such that it is not possible for the toggle lever to be pressed through the cutout.

It should also be envisaged again that the arrangement according to the invention can be used with or without an eye-catching object on the central closure part of the hinged closure. The central closure part then being designed preferably as a clasp.

BRIEF DESCRIPTION OF THE DRAWINGS

Examples of the arrangement according to the invention are described in more detail hereinbelow with preference to the drawings. Further advantages of the invention can be gathered from the following description text. In the drawings:

FIG. 7 shows an enlarged detail of a latching element of the arrangement illustrated in FIG. 6, FIG. 9 shows a side view of the arrangement shown in FIG. 6, the arrangement being in the circumferentially fully open state.

METHODS OF IMPLEMENTING THE INVENTION

The arrangement illustrated in FIGS. 1 to 4, with a strap designed as a closed bracelet, has a hinged closure 1. The hinged closure 1 is designed as a symmetrical unit. As central closure part, it has a watchcase 3 as eye-catching object. In each case one strap end 5*a* and 5*b* is fastened on the hinged closure 1 by a pivot articulation 6*a* and 6*b*, respectively. Furthermore, the strap has two concavely curved, mirror-symmetrical, rigid bracelet parts 7*a* and 7*b*, which are connected to one another by a bracelet pivot articulation 9. The concave curvature of the bracelet parts 7*a* and 7*b* is adapted to the shape of the surface of the human wrist.

On both sides of the watchcase 3, the hinged closure 1 has in each case one toggle lever 11*a* and 11*b* which is retained by pivot articulation 10*a* and 10*b* and of which the respective leg parts 13*a*, 13*b* and 13*c*, 13*d* are connected pivotally to one another by a pivot articulation 15*a* and 15*b*, respectively. The toggle levers 11*a* and 11*b* are mirror-symmetrical to one another. The leg part 13*a* and 13*c* is retained pivotably in each case on a side flange 14*a* and 14*b*, respectively, of the watchcase 3 such that it can be pivoted by the pivot articulation 10*a* and 10*b*, respectively. Starting from its end, each strap end region 5*a* and 5*b* has a U-shaped cutout 17*a* and 17*b*, respectively, which is open in the direction of the end and passes through the entire end region. The longitudinal sides 19*a,* 19*b* and 19*c,* 19*d* of the cutouts 17*a* and 17*b,* respectively, run parallel to the end edges 18*a* and 18*b* of the bracelet parts 7*a* and 7*b.* The two bracelet parts 7*a* and 7*b* are formed as equal-width links curved in accordance with the wrist contour, although this is not necessarily the case. Other shaping would also be possible. The axes of all the pivot articulations 6*a,* 6*b,* 9, 10*a,* 10*b,* 15*a* and 15*b* run parallel to one another.

Figure 1:
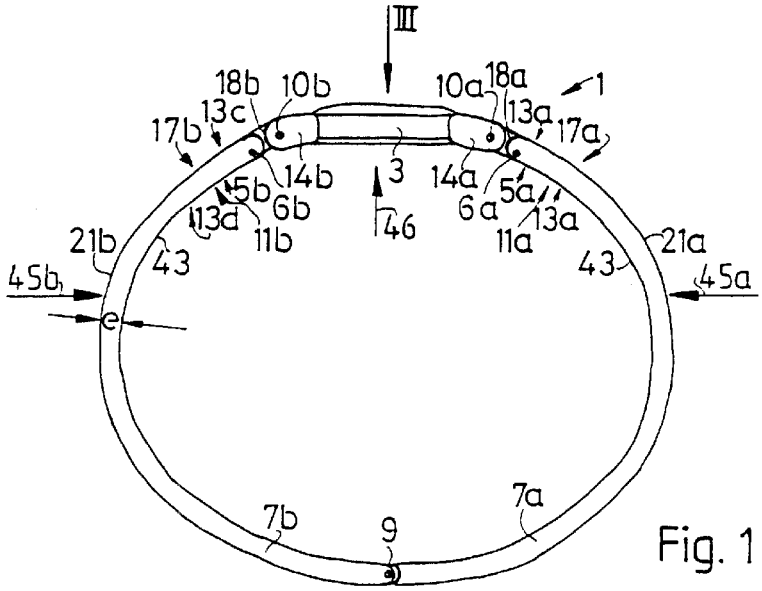
FIG. 1 shows a side view of the arrangement with an eye-catching object, with the hinged closure in the collapsed state.
Figure 2:
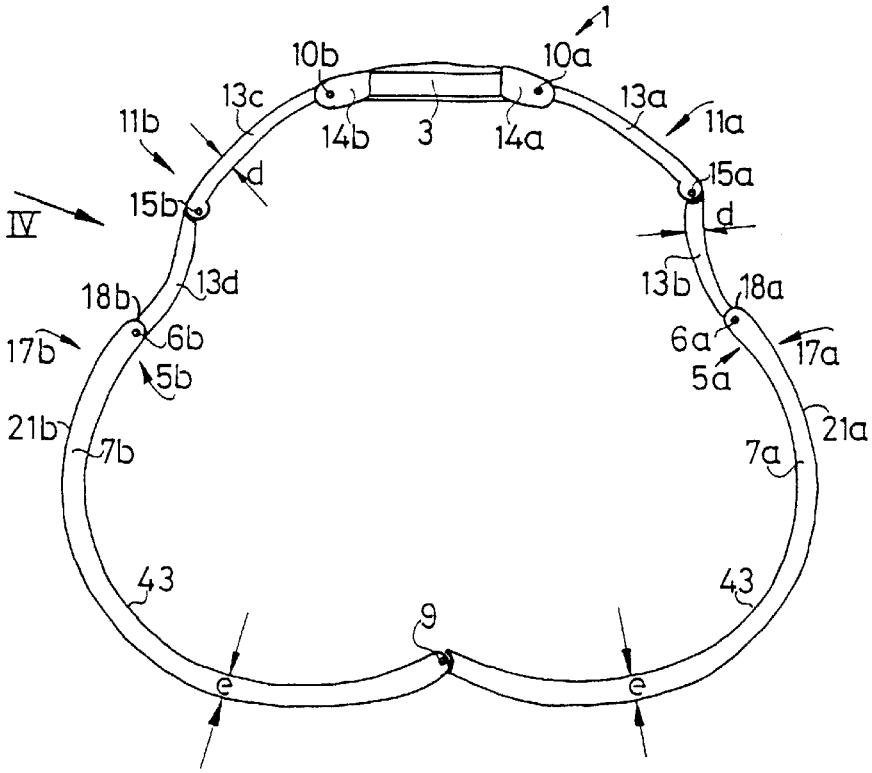
FIG. 2 shows a side view of the arrangement illustrated in FIG. 1, with the hinged closure in the swung-open state.
Figure 3:
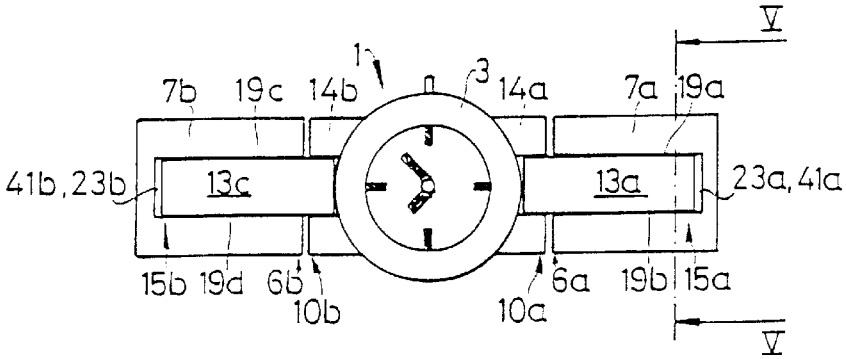
FIG. 3 shows a plan view of the arrangement illustrated in FIG. 1 in the viewing direction III from FIG. 1.

The leg parts 13*a* to 13*d* are likewise designed, corresponding to the width b of the cutout 17*a* and 17*b* apart from a tolerance, as same-width, concavely or convexly curved links. The link thickness d, apart from a second tolerance, is half the thickness of the respective bracelet end region e, which contains the relevant cutout. On account of the just-described thickness selection and of suitable concave and convex shaping of the leg parts 13*a* to 13*d,* the fully collapsed toggle levers 5*a* and 5*b,* as is illustrated in FIGS. 1 and 3, are located in a surface-flash manner in the respective cutouts 17*a* and 17*b.*

Figure 5:
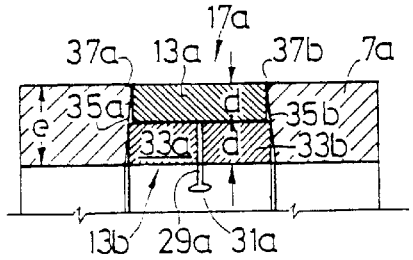
FIG. 5 shows a cross section, on an enlarged scale through the arrangement along line V—V in FIG. 3 in order to illustrate an example of the toggle lever latching in a cutout in the bracelet end region.

The function of a latching-in unit, which retains each collapsed toggle lever (in this case toggle lever 11*a*) in each cutout (in this case cutout 17*a*) counter to a force, is explained with reference to FIG. 5. FIG. 5 shows a section along run V—V in FIG. 3. This section is routed in the cutout base 23*a,* offset slightly in the direction of the cutout opening 25*a.* The respective latching-in unit is arranged in the vicinity of the cutout base 23*a* and 23*b,* that is to say as far away as possible from the respective pivot articulation 6*a* and 6*b* of the respective bracelet part 7*a* and 7*b* with the respective relevant leg part 13*b* and 13*d.* This arrangement spaced apart from the pivot articulation 6*a* and 6*b* results in a lever action, as a result of which even just a small latching-in action requires an increased opening force, although the latter is selected such that the toggle levers 11*a* and 11*b* positioned in a respective cutout 17*a* and 17*b* can nevertheless be swung open easily using one hand.

Figure 4:
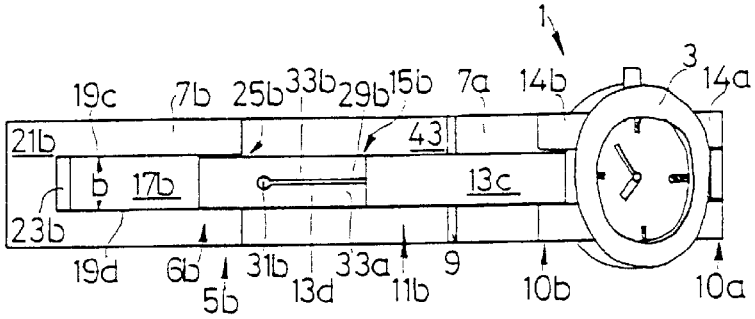
FIG. 4 shows a plan view of the arrangement illustrated in FIG. 2 in viewing direction IV from FIG. 2.

As can easily be seen in FIG. 4, the respectively one leg part 13*b* and 13*d* has a respective gap 29*a* and 29*b* which extends from the respective pivot articulation 15*a* and 15*b* and terminates in a respective through-passage hole 31*a* and 31*b.* The pivot articulation 15*a* and 15*b,* then, is designed such that the two links 33*a* and 33*b,* respectively, can be bent resiliently in relation to one another to the left and right of the gap 29*a,* 29*b,* respectively. In the region of the pivot articulation 15*a* and 15*b,* the overall width of the leg part 13*b* and 13*d,* respectively, is greater, by a latching tolerance, than that of the leg part 13*a* and 13*c,* respectively. However, with the gap 29*a* and 29*b* in the completely compressed state, the latching tolerance provides a width which is not at any time greater than the width b of the relevant cutout 17*a* and 17*b,* respectively, at the relevant location. The longitudinal sides 19*a* to 19*d* of each cutout 17*a* and 17*b* are designed, in the vicinity of the respective cutout base 23*a* and 23*b,* with a respective slope 35*a* and 35*b* which tapers outward slightly and have [sic] a respectively run-in edge 37*a* and 37*b* in relation to the respectively outer side 21*a* and 21*b* of the respective bracelet part 7*a* and 7*b.*

If the strap is to be put on the wrist once it has been slipped over the hand, the more or less straightened-out leg parts 13*a* to 13*d* of the toggle levers 11*a* and 11*b* are collapsed in order to decrease the overall circumference of the strap. In this case, with a collapsing action, two leg parts 13*a,* 13*b* and 13*c,* 13*d* are moved in the direction of the respective cutouts 17*a* and 17*b,* until the respective leg part 13*b* and 13*d,* in the region of the respective pivot articulation 15*a* and 15*b,* strikes against the respective outer side 21*a* and 21*b* of the respective bracelet 7*a* and 7*b* in the vicinity of the respective cutout base 23*a* and 23*b.* With further compression, two link parts 33*a* and 33*b* are then compressed counter to their spring action by way of the run-in edges 37*b* and 37*b.* On the following slopes 35*a* and 35*b,* the two leg parts 13*b* and 13*d* are relieved of stressing. The toggle levers 11*a* and 11*b* are then retained with latching action in the relevant cutouts 17*a* and 17*b,* respectively.

In order that, when the toggle levers 11*a* and 11*b* are pressed in, the latter are not pressed through the cutouts 17*a* and 17*b* onto the wrist, each cutout base 23*a* and 23*b* is provided with a slope 41*a* and 41*b,* respectively, which tapers in the direction of the inner side 43 of the respective bracelet part 7*a* and 7*b.*

In order to open the arrangement, the thumb and index finger are used to press in the direction of the arrows 45*a* and 45*b* approximately in the center of the bracelet parts 7*a* and 7*b,* whereupon the watchcase 3, which forms the central closure part, springs radially outward, by a gripping distance, in direction 46. In order to be opened further into the state shown in FIG. 2, it is then possible for the watchcase 3 to be gripped laterally by the thumb and index finger or middle finger and drawn further in the radially outward direction in order further to increase the circumference of the arrangement. This opening operation is described hereinbelow for a variant with reference to FIGS. 8 and 9.

The two cutouts 17*a* and 17*b* have been described above in the form of through-passages. It is also possible, however, with the same effect, to use a cutout which does not pass right through the relevant bracelet part, i.e. a cutout base with a wall thickness in the direction of the inner side 43 would still remain. The abovedescribed cutout configuration, however, provides a more straightforward production with a nevertheless pleasing appearance.

It is not necessary either for the cutout base 23*a* and 23*b,* as has been illustrated above, to have a surface which is perpendicular to the longitudinal sides 19*a* to 19*d* of the cutouts 17*a* and 17*b.* It is also possible to use a curved surface. The abovedescribed cutout base 23*a* and 23*b,* however, is more straightforward to produce in mechanical terms.

It is not absolutely necessary for the eye-catching object to be the central part of the symmetrical hinged closure 1. It is also possible to use a central part without an eye-catching object and then for an eye-catching object to be arranged on one, or for an eye-catching object to be arranged on both, of the leg part 13*a* and/or 13*b.* It is not necessary either for the hinged closure to be symmetrical. It is also possible for it to be designed, for example, with just one toggle lever.

As has been described above, the strap has the two rigid bracelet parts 7*a* and 7*b.* These bracelet parts 7*a* and 7*b* may consist of a precious metal or of other metals and also of plastic. Instead of the rigid bracelet parts 7*a* and 7*b,* however, it is also possible to use flectually elastic bracelet parts.

The abovedescribed latching unit is to be understood merely as an example. It would also be possible for the axis of the pivot articulations 15*a* and 15*b* to be designed, for example, to project and to be resilient on both sides. In this case, an upwardly widening blind bore would have to be provided at the corresponding location in the longitudinal sides 19*a* to 19*d.*

Figure 8:
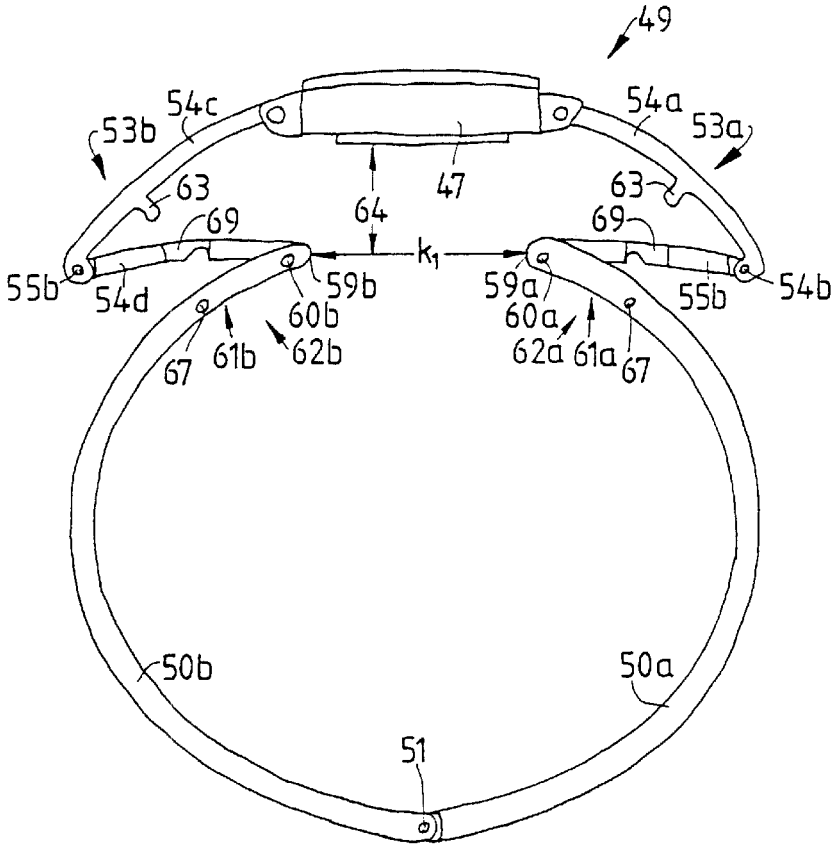
FIG. 8 shows a side view, of the arrangement illustrated in FIG. 6, in which the central closure part of the hinged closure is raised by a "gripping distance"
Figure 6:
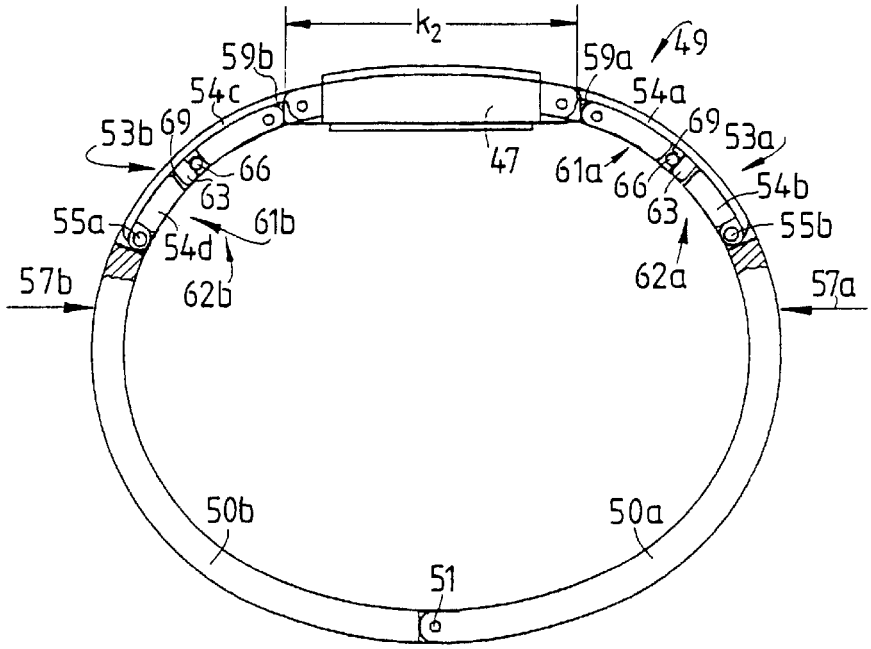
FIG. 6 shows a variant of the arrangements illustrated in FIGS. 1 to 5, this variant being in the circumferentially closed state and, in order to illustrate the toggle levers and the latching mechanisms thereof, the end regions of the bracelet parts of the arrangement being illustrated in the broken-away state.

FIGS. 6 and 7 show a variant of the arrangement illustrated in FIGS. 1 to 5. Here too, a watchcase 47 is provided as the eye-catching object and central closure part of a symmetrical hinged closure. The bracelet parts 50*a* and 50*b* are designed analogously to the bracelet parts 7*a* and 7*b* and are likewise connected pivotably by a bracelet pivot articulation, in this case designated 51. Here too, the hinged closure 49 has in each case one toggle lever 53*a* and 53*b* on both sides. Each toggle lever likewise has two leg parts 54*a,* 54*b* and 54*c,* 54*d,* which are connected pivotably in each case by a pivot articulation 55*a* and 55*b,* respectively. In contrast to the arrangement illustrated in FIGS. 1 to 5, however, the leg parts 54*a* and 54*c* in this case are connected rigidly to the watchcase 47 (central closure part). However, analogously to the leg parts 13*b* and 13*d,* the leg parts 54*b* and 54*d* are moveable and are retained pivotably at the bracelet end regions 62*a* and 62*b* by in each case one pivot articulation 60*a* and 60*b.* This configuration results in the arrangement "springing open" satisfactorily by virtue of lateral pressing on the bracelet parts 50*a* and 50*b* beneath the cutouts 61*a* and 61*b,* described hereinbelow, in the direction of the arrows 57*a* and 57*b.* The springing-open action is made possible, in addition, in that, in the closed state of the hinged closure 49, the pivot-articulation axes 55*a* and 55*b* are spaced apart from the bracelet pivot articulation 51 by a shorter spacing than the pivot articulations 60*a* and 60*b.* FIG. 8 shows the "sprung-open" state of the arrangement. In this state, the spacing $k_1$ between the bracelet end edges 59*a* and 59*b* is smaller than the spacing $k_2$ in the closed state, as is shown in FIG. 6. This reduced spacing, however, also reduces the diameter of the arrangement; however, it is not small enough to pinch the wrist. In the "sprung-open" state, the watchcase 47 is raised up in a radially outward direction by a "gripping distance" 64. The watchcase can then be gripped laterally to good effect by the thumb and the index finger or middle finger, as a result of which, in order to increase the circumference further, the arrangement can be moved into the state shown in FIG. 9. This increases the spacing between the opposite bracelet end edges to $k_3$. It is then possible for the open arrangement to be slipped over the wrist.

The in each case two leg parts 54*a* to 54*d* of the toggle levers 53*a* and 53*b* are retained with latching action in a cutout 61*a* and 61*b* in the bracelet part 50*a* and 50*b,* said cutout being designed analogously to the cutout 17*a* and 17*b.* The magnitude of the latching force is selected such that the arrangement is not opened by accidental lateral impacts. It would also be necessary for these impacts to take place simultaneously on both sides. An impact on one side in the normal scale of events (i.e. one which does not cause injury) does not have any effect. The width of the in each case two link-design leg parts 54*a,* 54*b* and 54*c,* 54*d* is selected such that these parts can be introduced into the clearance 61*a* and 61*b,* respectively, with a clearance fit. The latching-action securing means is designed differently to the latching securing means of the arrangement shown in FIGS. 1 to 5.

The latching securing means illustrated in FIG. 7 shows an enlarged illustration of the leg part 54*c*. The leg part 54*a* is designed analogously to this, but in a mirror-inverted manner. This leg part 54*c* has, on both sides, in each case one extension 63 which projects downward approximately in the center and has a protuberance 65. In the closed state of the arrangement, this protuberance 65 engages around a tubular element 66 arranged in each cutout 61*a* and 61*b.* Each tubular element 66 is retained in the respective cutout by a crosspiece 67 running in it. In the closed state of the arrangement, the extension 63 engages through in each case one lateral notch 69 on the leg part 54*b* and 54*d*. The leg part 54*d* is mirror-symmetrical to the leg part 54*b*. For opening by lateral pressure being applied to the bracelet parts 50*a* and 50*b,* the protuberance 65 is pressed away, i.e. in the obliquely outward direction, from the tubular element 66 or crosspiece 67 and the latching is thus eliminated. By virtue of one latching part being designed as crosspiece 67 with an encasing tubular element 66, material abrasion can be reduced to a very pronounced extent and the service life of the latching unit can thus be significantly increased.

In addition, the crosspiece 67 arranged in each cutout 61*a* and 61*b* prevents the toggle levers 53*a* and 53*b* from being pressed through the cutouts 61*a* and 61*b*. As a result, the rigid fastening of the leg parts 54*a* and 54*b* on the central closure part 47 is additionally protected against being broken off.

In order to close the arrangement on the wrist, it is slipped over the hand. The two bracelet parts 50*a* and 50*b* are then lightly compressed between the thumb and one or more fingers of the other hand more or less at the location of the arrows 57*a* and 57*b*. On account of the leg part 54*a* and 54*c* connected rigidly and fixedly to the central closure part 47 (watchcase), the central closure part 47 comes to rest, during the compressing operation, over the gap between the two bracelet end edges 59*a* and 59*b*. If one then lets go of the bracelet parts 50*a* and 50*b,* the hinged closure 49 then collapses in on itself, provided it is located on the upper side of the wrist, on account of the gravitational force. The toggle levers 53*a* and 53*b* are then located in part in the cutouts 61*a* and 61*b*. By virtue of pressure then being applied to the leg parts 54*a* and 54*c* swung into the cutouts 61*a* and 61*b,* the toggle levers 53*a* and 53*b* then latch in a surface-flush manner into the cutouts 61*a* and 61*b*. Twisting of parts of the hinged closure 49 as a result of careless closure is no longer possible here; any possibilities of incorrect actuation are ruled out. For closure purposes, one will preferably apply pressure to the leg parts 54*a* and 54*c* at the location of the latching elements. However, it is also possible for closure to take place simply by virtue of pressing on the central closure part.

What is claimed is:

1. A circumferentially continuous arrangement which is to be worn preferably on a wrist comprising:

a strap with two strap end regions each with a strap end and a hinged closure, which serves for changing the circumferential extent of the arrangement, said hinged closure having a central closure part and at least one collapsible toggle lever, said toggle lever being offset circumferentially with respect to the central closure part, said toggle lever having two toggle leg parts, said two toggle leg parts being connected to one another in an articulated manner by a pivot articulation, one of said toggle leg parts being connected to the central closure part and the other of said toggle leg parts being fastened to one of said strap end regions, wherein at least one strap end region having a cutout, which passes through the whole thickness of the strap end region, said cutout starting from the strap end, in said cutout the hinged closure being positioned in the collapsed state, where the two leg parts being folded, the collapsible toggle lever, and the central closure part are designed and connected to one another such that for the direct transition from the closed state of the hinged closure to the open state, the central closure part is to be moved, or moves outward.

2. The arrangement according to claim 1, wherein the sum of the thicknesses of the respectively first and second leg parts of each toggle lever, apart from a tolerance, is equal to the thickness of the strap end region, and preferably in each case one leg part is of concave design and the other is of convex design with one of the curvatures of the respective strap end region so that, in the closed state of the arrangement, the collapsed toggle levers are positioned in a surface-flash manner in the respective cutout.

3. The arrangement according to claim 1, wherein, in the closed state of the arrangement, each pivot articulation of the two leg parts comes to rest at a remote location from the central closure part and preferably one leg part of each toggle lever fixedly is connected, so that the central closure part can drop into a substantially closed state, from which it can be pressed into the fully closed state without there being any possibility of incorrect actuation.

4. The arrangement according to claim 1, including a stop in each cutout for preventing the toggle lever from being pressed through the cutout.

5. The arrangement according to claim 1, wherein the hinged closure has an eye-catching object.

6. The arrangement according to claim 1, wherein the strap has at least two non-deformable bracelet parts which are adapted to the wrist contour, the strap has at least two non-deformable bracelet parts which are adapted to the wrist contour, said bracelet parts are connected to one another pivotably by a bracelet articulation.

7. The arrangement according to claim 1, wherein, the hinged closure bears an eye-catching object.

8. The arrangement according to claim 1, wherein the central closure part of the hinged closure bears an eye-catching object.

9. The arrangement according to claim 1, including a second toggle lever, so that the hinged closure is designed as a symmetrical unit with a toggle lever on both sides of the central closure part.

10. The arrangement according to claim 1, wherein, the strap has at least two non-deformable bracelet parts, which are adapted to the wrist contour and are connected to one another pivotably by a bracelet pivot articulation.

11. The arrangement according to claim 10, wherein, the at least two non-deformable bracelet parts are symmetrically to one another.

12. The arrangement according to claim 10, wherein each of the two bracelet parts has a bracelet end edge, the bracelet end edges of the two bracelet parts having a spacing from one another, each toggle lever, the central closure, and the two bracelet parts are such that the spacing of the bracelet end edges is small when the central closure part is raised up outward by a gripping distance, in order that, by lateral pressing, opening of the arrangement is possible by virtue of the central closure part springing upward from the closed state and being gripped in order to be opened further.

13. The arrangement according to claim 1, including a latching unit which retains the collapsed toggle levers in the relevant cutout until an opening force is applied.

14. The arrangement according to claim 13, wherein, the latching unit is in two parts with a first and a second latching-element part, said first latching-element part being a slope and said second latching-element part being a widened formation on the toggle lever.

15. The arrangement according to claim 14, wherein the first and second latching-element parts being a slope shape, which is arranged in the cutout.

16. The arrangement according to claim 14, wherein the cutout has a cutout base and the first latching-element part being a slope shape, which is arranged in the cutout and in the vicinity of the cutout base said slope shape tapers towards the outer side of the strap or bracelet outer side.

17. The arrangement according to claim 14, wherein the second latching-element being a widened formation on the toggle lever, one of the toggle leg parts has a compressible gap which runs in the direction of the pivot articulation, said gap producing a spring action.

18. The arrangement according to claim 17, wherein, the toggle leg part with the compressible gap is the one which comes to rest on top in the collapsed state of the toggle lever.

* * * * *

UNITED STATES PATENT AND TRADEMARK OFFICE

CERTIFICATE OF CORRECTION

PATENT NO. : 6,505,763 B2
DATED : January 14, 2003
INVENTOR(S) : Rota

It is certified that error appears in the above-identified patent and that said Letters Patent is hereby corrected as shown below:

Title page,
Item [73], delete "Assignee: Meliga Habillement Horloger SA" and insert -- Assignee: Montres Antima SA --

Signed and Sealed this

Second Day of September, 2003

JAMES E. ROGAN
*Director of the United States Patent and Trademark Office*